US009527564B2

(12) United States Patent
Kinoshita

(10) Patent No.: US 9,527,564 B2
(45) Date of Patent: Dec. 27, 2016

(54) SMALL VESSEL PROPULSION SYSTEM

(71) Applicant: YAMAHA HATSUDOKI KABUSHIKI KAISHA, Iwata-shi, Shizuoka (JP)

(72) Inventor: Yoshimasa Kinoshita, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/814,650

(22) Filed: Jul. 31, 2015

(65) Prior Publication Data

US 2016/0039503 A1 Feb. 11, 2016

(30) Foreign Application Priority Data

Aug. 8, 2014 (JP) ..... 2014-162713

(51) Int. Cl.

| | |
|---|---|
| ***B60L 3/00*** | (2006.01) |
| ***B63H 11/11*** | (2006.01) |
| ***B63B 35/73*** | (2006.01) |
| ***B63H 11/04*** | (2006.01) |
| ***B63H 11/113*** | (2006.01) |
| ***B63H 21/21*** | (2006.01) |

(52) U.S. Cl.

CPC ..... *B63H 11/11* (2013.01); *B63B 35/731* (2013.01); *B63H 11/04* (2013.01); *B63H 11/113* (2013.01); *B63H 21/213* (2013.01); *B63H 2021/216* (2013.01)

(58) Field of Classification Search

None

See application file for complete search history.

(56) References Cited

U.S. PATENT DOCUMENTS

| | | | | |
|---|---|---|---|---|
| 9,403,586 | B2 * | 8/2016 | Okamoto | B63H 11/11 |
| 2006/0160437 | A1 | 7/2006 | Kinoshita et al. | |
| 2009/0250278 | A1 * | 10/2009 | Kawasaki | B60K 1/02 180/65.275 |

(Continued)

FOREIGN PATENT DOCUMENTS

JP 2006-200442 A 8/2006

OTHER PUBLICATIONS

Okamoto et al., "Jet Propelled Watercraft," U.S. Appl. No. 14/814,637, filed Jul. 31, 2015.

(Continued)

*Primary Examiner* — Adam Alharbi

(74) *Attorney, Agent, or Firm* — Keating & Bennett, LLP

(57) ABSTRACT

A small vessel propulsion system includes a mode switching signal output outputting a mode switching signal to switch a travel mode among a plurality of travel modes including a first mode of making a small vessel travel in accordance with operation of an accelerator operator and a second mode of making the small vessel travel in accordance with a command different from the operation of the accelerator operator, and a controller configured or programmed to switch the shift position of the shift mechanism to the forward drive position by controlling the shift actuator and switch the travel mode to the second mode when the mode switching signal output outputs the mode switching signal to switch from the first mode to the second mode and the shift position detector detects a shift position other than the forward drive position.

10 Claims, 11 Drawing Sheets

(56) References Cited

U.S. PATENT DOCUMENTS

| | | | | |
|---|---|---|---|---|
| 2010/0113213 | A1* | 5/2010 | Oba | B60K 6/445 477/5 |
| 2013/0344754 | A1 | 12/2013 | Kinoshita | |

OTHER PUBLICATIONS

Okamoto et al., "Jet Propelled Watercraft," U.S. Appl. No. 14/814,645, filed Jul. 31, 2015.
Okamoto, "Jet Propelled Watercraft," U.S. Appl. No. 14/814,648, filed Jul. 31, 2015.

* cited by examiner

SMALL VESSEL PROPULSION SYSTEM

BACKGROUND OF THE INVENTION

1. Field of the Invention

The present invention relates to a small vessel propulsion system preferably for use in a small vessel, such as a jet propelled watercraft, an outboard motor craft, etc. A small vessel refers to a vessel with a gross tonnage of less than 20 tons. However, a vessel with a gross tonnage of not less than 20 tons is included in small vessels if its length is less than 20 meters.

2. Description of the Related Art

A jet propelled watercraft includes a jet pump that jets water rearward from a jet port and a reverse gate that changes a direction of the jet flow jetted from the jet pump. The reverse gate is movable, for example, among a forward drive position, a reverse drive position, and a neutral position in between. The forward drive position is a position at which no portion of the jet port is covered by the reverse gate in a rear view viewed along a jetting direction of the water jetted from the jet port. The reverse drive position is a position at which an entirety of the jet port is covered by the reverse gate in the rear view. The neutral position is a predetermined position between the forward drive position and the reverse drive position.

With a jet propelled watercraft or other small vessel, travel within a slow-speed zone in which travel speed is limited or travel in shallow waters may be performed over a long period of time. However, a vessel operator tends to become tired when travel while maintaining a low speed state is performed over a long period of time because accelerator operation is monotonous. Japanese Patent Application Publication No. 2006-200442 thus disclosed a jet propelled watercraft having, as a travel mode, a low-speed travel mode (low-speed setting mode) of traveling at a predetermined low speed set in advance. This jet propelled watercraft includes a low-speed travel mode switch (low-speed setting switching) arranged to switch the travel mode to the low-speed travel mode.

SUMMARY OF THE INVENTION

The inventor of preferred embodiments of the present invention described and claimed in the present application conducted an extensive study and research regarding a small vessel propulsion system, such as the one described above, and in doing so, discovered and first recognized new unique challenges and previously unrecognized possibilities for improvements as described in greater detail below.

With the jet propelled watercraft according to Japanese Patent Application Publication No. 2006-200442, that an accelerator operation amount is a predetermined amount is made a condition for allowing switching to the low-speed travel mode in order to prevent degradation of riding comfort in the process of transition to the low-speed travel mode. With the jet propelled watercraft according to Japanese Patent Application Publication No. 2006-200442, another condition for allowing the switching to the low-speed travel mode is that the reverse gate is at the forward drive position. Therefore, in order to switch the travel mode to the low-speed travel mode when the reverse gate is at a position other than the forward drive position, an operator must switch the reverse gate to the forward drive position and thereafter further operate the low-speed travel mode switch.

Generally, a slow-speed zone is set at a periphery of a docking location. On the other hand, in docking a jet propelled watercraft, an operation of moving the reverse gate to the neutral position is performed in many cases. Therefore in many cases where the jet propelled watercraft is to be started in the low-speed travel mode after docking, an operation of switching the reverse gate from the neutral position to the forward drive position must be performed. Therefore, in starting the jet propelled watercraft, the vessel operator must switch the reverse gate from the neutral position to the forward drive position and thereafter perform the operation of switching to the low-speed travel mode and the starting operation is thus cumbersome.

The slow-speed zone is a so-called "no-wake zone." The low-speed travel mode is a so-called "no wake mode."

In order to overcome the previously unrecognized and unsolved challenges described above, a preferred embodiment of the present invention provides a propulsion system configured to apply a propulsive force to a body of a small vessel. The small vessel propulsion system includes a propulsion device including a shift mechanism capable of being switched among a plurality of shift positions including a forward drive position of applying a forward drive direction propulsive force to the body, a shift actuator configured to switch the shift position of the shift mechanism, a shift position detector detecting the shift position of the shift mechanism, an accelerator operator operated by an operator to set a travel speed of the small vessel, a mode switching signal output outputting a mode switching signal to switch a travel mode among a plurality of travel modes including a first mode of making the small vessel travel in accordance with operation of the accelerator operator and a second mode of making the small vessel travel in accordance with a command different from the operation of the accelerator operator, and a controller configured or programmed to switch the shift position of the shift mechanism to the forward drive position by controlling the shift actuator and switch the travel mode to the second mode when the mode switching signal output outputs the mode switching signal to switch from the first mode to the second mode and the shift position detector detects a shift position other than the forward drive position.

With this arrangement, if the mode switching signal of switching from the first mode to the second mode is output when the shift position of the shift mechanism is other than the forward drive position, the controller switches the shift position of the shift mechanism to the forward drive position. The travel mode is thus switched from the first mode to the second mode even if the operator does not perform an operation to switch the shift position of the shift mechanism to the forward drive position. An operation to switch the travel mode from the first mode to the second mode is thus simple.

A preferred embodiment of the present invention further includes a shift switching signal output outputting a shift switching signal to switch the shift position of the shift mechanism, and the controller is configured or programmed to control the shift actuator in accordance with the shift switching signal output by the shift switching signal output. With this arrangement, the shift position of the shift mechanism is switched in accordance with the shift switching signal output from the shift switching signal output. On the other hand, when the mode switching signal to switch the travel mode from the first mode to the second mode is output, the shift position of the shift mechanism is automatically switched to the forward drive position regardless of the shift switching signal. The operation to switch the travel mode is thus simple.

In a preferred embodiment of the present invention, the propulsion device includes a jet pump jetting water from a jet port, and the shift mechanism includes a reverse gate movable between a forward drive position at which an entirety of the jet port is open in a rear view viewed along a jetting direction of the water jetted from the jet port and a position besides the forward drive position at which at least a portion of the jet port is covered by the reverse gate in the rear view. Therefore, when the mode switching signal to switch the travel mode from the first mode to the second mode is output, the reverse gate is guided automatically to the forward drive position. The operation to switch the travel mode is thus simple.

In a preferred embodiment of the present invention, the shift position detector is configured to detect the position of the reverse gate. The position of the reverse gate is thus controlled automatically in the process of switching the travel mode.

In a preferred embodiment of the present invention, the second mode is a low-speed travel mode of making the small vessel travel at a predetermined low speed. With this arrangement, the shift position is automatically set to the forward drive position when switching to the low-speed travel mode is performed, and therefore the operation to switch to the low-speed travel mode is simple.

In a preferred embodiment of the present invention, the controller is configured or programmed to switch the travel mode from the first mode to the second mode under a condition that a predetermined second mode travel condition is satisfied when the mode switching signal output outputs the mode switching signal to switch from the first mode to the second mode. The switching from the first mode to the second mode can thus be performed appropriately, and in this process, the shift position of the shift mechanism is automatically guided to the forward drive position. The switching of the travel mode from the first mode to the second mode is thus performed appropriately by a simple operation.

The second mode travel condition may include, for example, a condition that the accelerator operator is in a state of not being operated. If the propulsion device includes a prime mover, the second mode travel condition may include, for example, a condition that a rotational speed of the prime mover is not more than a predetermined speed.

In a preferred embodiment of the present invention, the controller is configured or programmed to switch the travel mode to the second mode after switching the shift position of the shift mechanism to the forward drive position. The shift position is thus automatically controlled appropriately first and then the travel mode is switched so that an appropriate mode switching actuation by a simple operation is realized by automatic control.

In a preferred embodiment of the present invention, the controller is configured or programmed to switch the travel mode to the second mode without switching the shift position of the shift mechanism when the mode switching signal output outputs the mode switching signal to switch from the first mode to the second mode and the shift position detector is detecting the forward drive position. If the shift position is the forward drive position, the control of changing the shift position is unnecessary. The shift position is thus automatically set appropriately and the travel mode is able to be switched by a simple operation while eliminating waste of control.

In a preferred embodiment of the present invention, the controller is configured or programmed to start the propulsion device, control the shift actuator to switch the shift position of the shift mechanism to the forward drive position, and set the travel mode to the second mode when, while the propulsion device is stopped, the mode switching signal output outputs the mode switching signal to switch from the first mode to the second mode and the shift position detector detects a shift position other than the forward drive position.

With this arrangement, when, while the propulsion device is stopped, the mode switching signal to switch the travel mode from the first mode to the second mode is output, the propulsion device is started automatically and the shift position of the shift mechanism is switched automatically to the forward drive position. Therefore an operator does not have to perform an operation for starting the propulsion device or perform an operation to switch the shift position of the shift mechanism to the forward drive position. Traveling in the second mode is thus started by a simple operation.

In a preferred embodiment of the present invention, the controller is configured or programmed to start the propulsion device and set the travel mode to the second mode without switching the shift position of the shift mechanism when, while the propulsion device is stopped, the mode switching signal output outputs the mode switching signal to switch the travel mode from the first mode to the second mode and the shift position detector detects the forward drive position.

With this arrangement, when, while the propulsion device is stopped, the mode switching signal to switch the travel mode from the first mode to the second mode is output, the propulsion device is started automatically and the travel mode is set to the second mode without switching of the shift position if the shift position of the shift mechanism is the forward drive position. An operation for starting in the second mode is thus simple.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
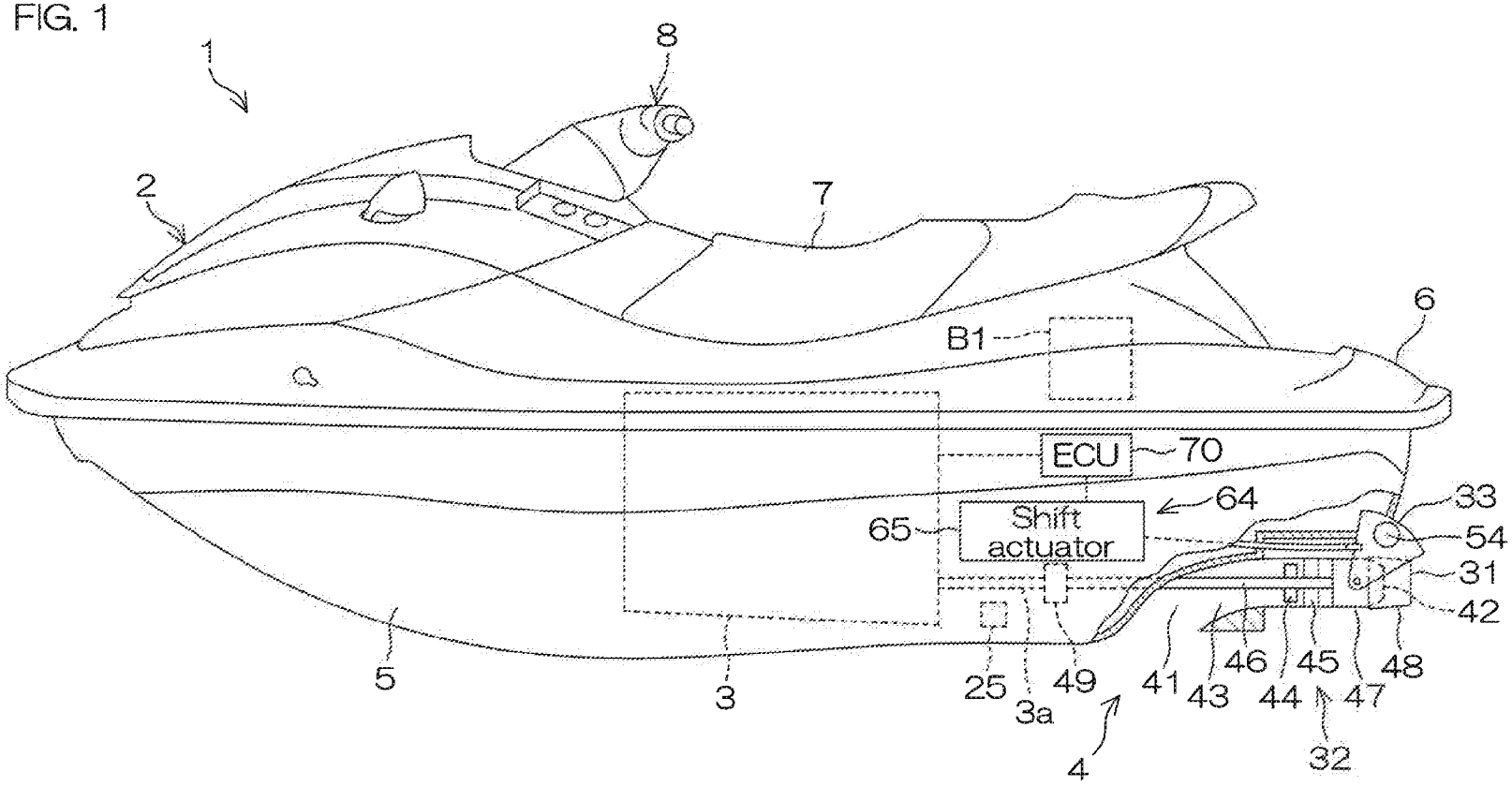
FIG. 1 is a schematic view of a jet propelled watercraft to which a small vessel propulsion system according to a preferred embodiment of the present invention is applied.

FIG. 1 is a schematic view of a jet propelled watercraft to which a small vessel propulsion system according to a preferred embodiment of the present invention is applied. The jet propelled watercraft 1 is an example of a small vessel used to travel on a body of water, such as a lake or sea, etc. The jet propelled watercraft 1 according to the present preferred embodiment preferably is a personal watercraft (PWC), for example.

The jet propelled watercraft 1 includes a body 2, an engine 3 as a prime mover disposed in an interior of the body 2, and a jet propulsion device 4 mounted on a rear portion of the body 2. The engine 3 and the jet propulsion device 4 constitute a propulsion generator that applies a propulsive force to the body 2.

The body 2 includes a hull 5 that defines a watercraft bottom and a deck 6 disposed above the hull 5. The engine 3 is disposed in a space defined between the hull 5 and the deck 6. Further in the space is disposed a battery B1 that supplies electric power to electrical equipment included in the jet propelled watercraft 1. The engine 3 is disposed in front of the jet propulsion device 4.

The engine 3 is an internal combustion engine that includes a crankshaft 3*a* rotatable around a rotation axis extending in a front/rear direction. The engine 3 includes an engine speed sensor 25 configured to detect a rotational speed of the engine 3. The jet propulsion device 4 is driven by the engine 3. The jet propulsion device 4 jets water, sucked into a watercraft interior (into the interior of the body 2) from the watercraft bottom, to a watercraft exterior (exterior of the body 2) to generate the propulsive force to propel the jet propelled watercraft 1 forward or in reverse.

A seat 7, on which an operator sits, is disposed on the deck 6. The seat 7 is disposed above the engine 3. The seat 7 is disposed at a center in a width direction of the jet propelled watercraft 1. A handle 8 is disposed in front of the seat 7. The handle 8 is an operating member operated by the operator to change a direction of the body 2.

Figure 2:
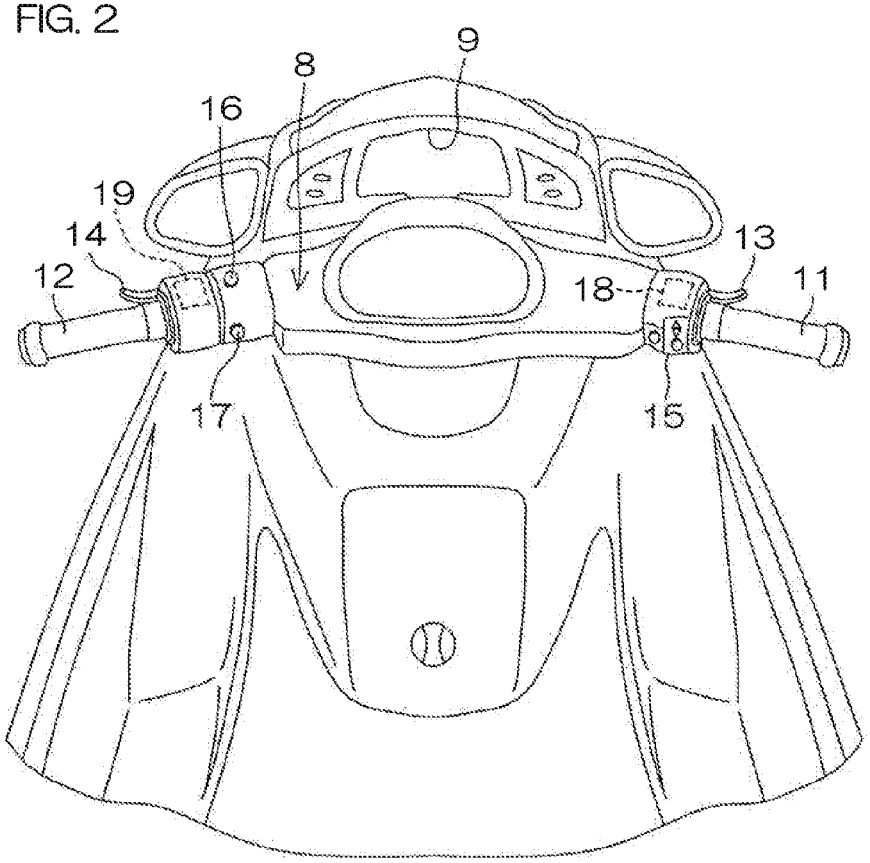
FIG. 2 is a perspective view of the arrangement of a vicinity of a handle of the jet propelled watercraft.

FIG. 2 is a perspective view of the arrangement of a vicinity of the handle 8. A display 9 is disposed in front of the handle 8. The handle 8 includes a right grip 11 and a left grip 12. A first accelerator operator (accelerator operator) 13 is rotatably mounted on the right grip 11. A second accelerator operator (reverse gate operator) 14 is rotatably mounted on the left grip 12. On the handle 8, an operation box 15 is mounted at an inner side of the right grip 11. A start switch 16 to start the engine and a stop switch 17 to stop the engine are provided at an inner side of the left grip 12 of the handle 8.

The first accelerator operator 13 is mainly operated to drive the jet propelled watercraft 1 forward. In the present preferred embodiment, the first accelerator operator 13 preferably is a lever type that includes an accelerator lever. An amount of operation of the first accelerator operator 13 (operation angle of the accelerator lever; hereinafter referred to as the "first accelerator operation amount Am1") is detected by a first accelerator position sensor 18. The first accelerator position sensor 18 is, for example, a potentiometer. The first accelerator position sensor 18 is an example of an accelerator operation detector that detects an operation state of the first accelerator operator 13.

The second accelerator operator 14 is mainly operated to drive the jet propelled watercraft 1 in reverse or to reduce a forward speed of the jet propelled watercraft 1. In the present preferred embodiment, the second accelerator operator 14 preferably is a lever type that includes a reverse lever. An amount of operation of the second accelerator operator 14 (operation angle of the reverse lever; hereinafter referred to as the "second accelerator operation amount Am2") is detected by a second accelerator position sensor 19. The second accelerator position sensor 19 preferably is, for example, a potentiometer.

Figure 3:
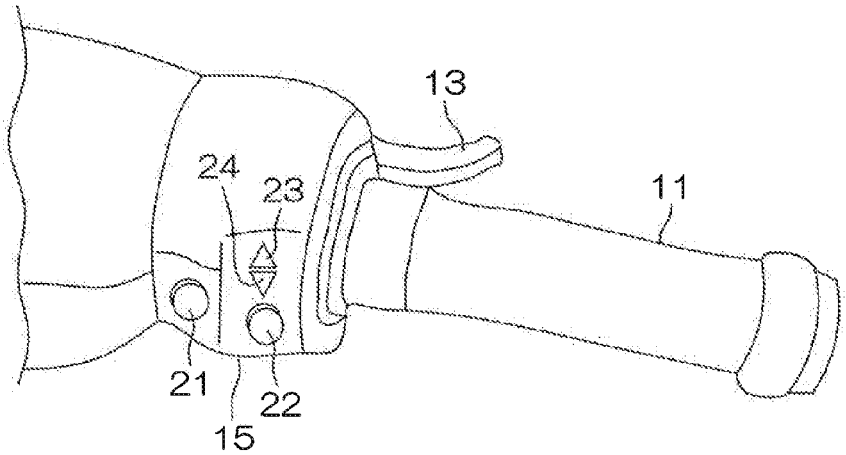
FIG. 3 is an enlarged perspective view of the arrangement of a vicinity of a right grip of the handle.

FIG. 3 is an enlarged perspective view of the arrangement of a vicinity of the right grip of the handle. A low-speed travel mode switch 21, a constant-speed travel mode switch 22, an acceleration fine adjustment switch 23, and a deceleration fine adjustment switch 24 are provided in the operation box 15. The switches 21 to 24 are disposed in a region enabling operation with a right thumb of the operator in a state where he/she holds the right grip 11 with the right hand.

The jet propelled watercraft 1 is made to travel in any of a plurality of travel modes. The plurality of travel modes include an ordinary travel mode, a low-speed travel mode, and a constant-speed travel mode, for example. The ordinary travel mode is a travel mode (first mode) in which the jet propelled watercraft 1 travels at a speed that is in accordance with operations of the first accelerator operator 13 and the second accelerator operator 14. The low-speed travel mode is a mode (second mode) in which the jet propelled watercraft 1 travels at a predetermined low speed. The constant-speed travel mode is a mode in which the jet propelled watercraft 1 travels at the speed at the point at which the constant-speed travel mode switch 22 is operated.

The low-speed travel mode switch 21 is a switch configured to set the travel mode to the low-speed travel mode and is an example of a mode switching signal output that outputs a mode switching signal to switch from the ordinary travel mode to the low-speed travel mode. The fine adjustment switches 23 and 24 are switches configured to finely adjust the speed of the jet propelled watercraft 1 in the low-speed travel mode. The constant-speed travel mode switch 22 is a switch configured to set the travel mode to the constant-speed travel mode.

As shown in FIG. 1, the jet propulsion device 4 includes a jet pump 32, by which water of the watercraft exterior that is sucked in from the watercraft bottom is jetted rearward, and a reverse gate 33, which changes a direction of a jet flow jetted from the jet pump 32.

The jet pump 32 includes an intake 41 through which the watercraft exterior water is sucked in, an outlet 42 from which the water sucked in from the intake 41 is jetted rearward, and a flow passage 43 guiding the water sucked into the intake 41 to the outlet 42. The jet pump 32 further includes an impeller 44 (rotor vane) and a stator vane 45 that are disposed in the flow passage 43, a driveshaft 46 coupled to the impeller 44, a nozzle 47 defining the outlet 42, and a deflector 48 inclining the direction of the jet flow, jetted rearward from the nozzle 47, to the right and left.

The intake 41 is opened at the watercraft bottom and the outlet 42 is opened rearward further to the rear than the intake 41. The driveshaft 46 extends in the front/rear direction. A front end portion of the driveshaft 46 is disposed inside the watercraft and a rear end portion of the driveshaft 46 is disposed in the flow passage 43. The front end portion of the driveshaft 46 is coupled to the crankshaft 3*a* of the engine 3 via a coupling 49. The impeller 44 is coupled to the driveshaft 46. The stator vane 45 is disposed rearward of the impeller 44. The nozzle 47 is disposed rearward of the stator vane 45. The impeller 44 is rotatable around a central axis of the driveshaft 46 with respect to the flow passage 43. The stator vane 45 is fixed with respect to the flow passage 43. The nozzle 47 is fixed to the body 2.

The engine 3 drives the impeller 44, together with the driveshaft 46, around the central axis of the driveshaft 46. When the impeller 44 is driven to rotate, water is sucked into the flow passage 43 from the intake 41 and the water sucked into the flow passage 43 is fed from the impeller 44 to the stator vane 45. By the water fed by the impeller 44 passing through the stator vane 45, torsion of water flow generated by rotation of the impeller 44 is reduced and the water flow is straightened. The flow-straightened water is thus fed from the stator vane 45 to the nozzle 47. The nozzle 47 has a tubular form extending in the front/rear direction and the outlet 42 is formed by a rear end portion of the nozzle 47. The water fed to the nozzle 47 is thus jetted rearward from the rear end portion of the nozzle 47.

Figure 4:
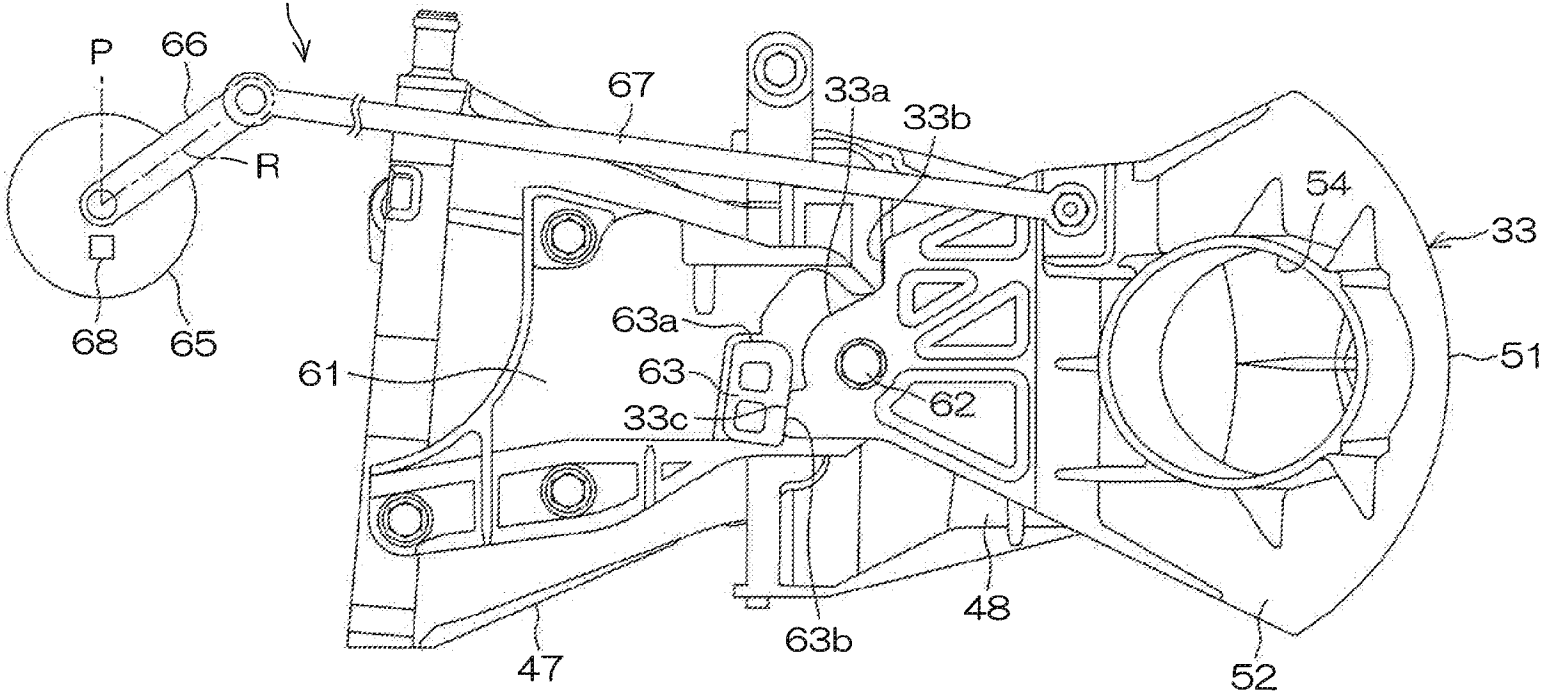
FIG. 4 is a schematic side view of the jet propelled watercraft in a state where a reverse gate is at a reverse drive position.
Figure 5:
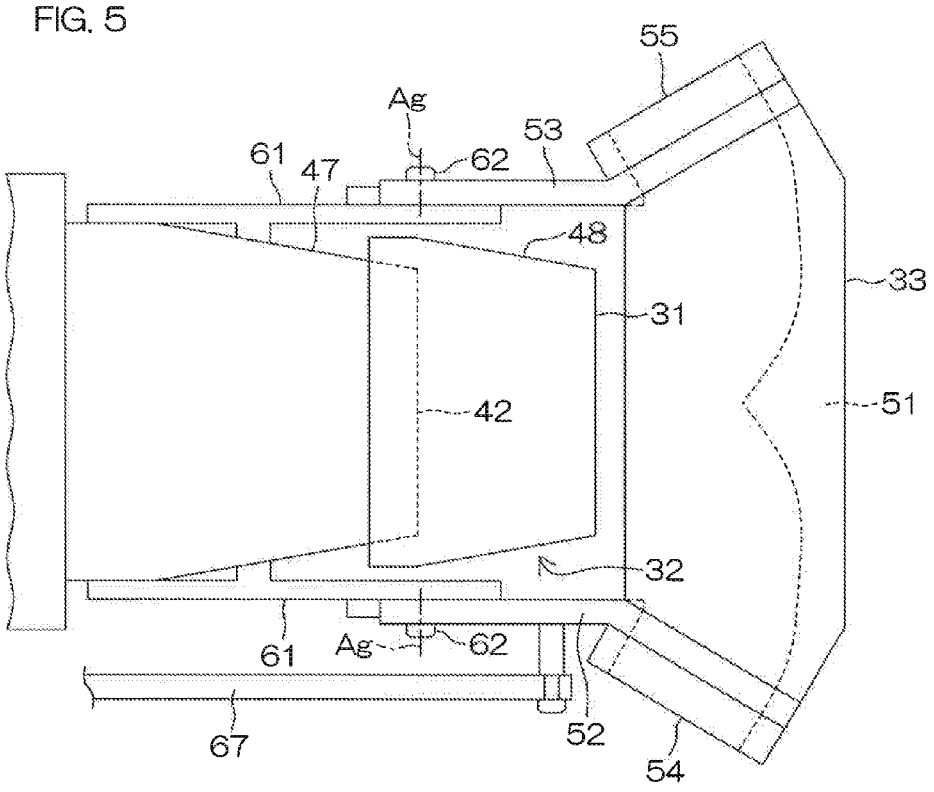
FIG. 5 is a schematic plan view of the arrangement of FIG. 4.

FIG. 4 is a schematic side view showing the arrangement of a vicinity of the nozzle 47 in enlarged manner. FIG. 5 is a schematic plan view of the arrangement of FIG. 4. The deflector 48 is disposed rearward of the nozzle 47. The deflector 48 is supported by the nozzle 47 in a manner enabling rotation in a right/left direction. The deflector 48 has a hollow tube shape. The outlet 42 of the nozzle 47 is disposed inside the deflector 48. The deflector 48 defines a jet port 31 that is opened rearward. The jet port 31 is disposed rearward of the outlet 42. The water that is jetted rearward from the nozzle 47 passes through an interior of the deflector 48 and is jetted from the jet port 31. A jetting direction of the water is in accordance with a right/left direction angle of the deflector 48.

The reverse gate 33 is supported by the nozzle 47 in a manner enabling rotation around an up/down rotation axis Ag extending in the right/left direction. For the sake of description, in the following, front, rear, up, and down with respect to the reverse gate 33 shall refer to front, rear, up, and down as defined in a state where the reverse gate 33 is at the position shown in FIG. 4 and FIG. 5. The reverse gate 33 includes a rear wall 51 as an opening/closing portion that opens/closes the jet port 31 of the deflector 48, a left side wall 52 extending frontward from a left side portion of the rear wall 51, and a right side wall 53 extending frontward from a right side portion of the rear wall 51. The left side wall 52 and the right side wall 53 have fan shapes spreading toward the rear in side view. A left opening 54 that is opened obliquely forward to the left is located near a rear end of the left side wall 52. A right opening 55 that is opened obliquely forward to the right is located near a rear end of the right side wall 53. The left opening 54 and the right opening 55 are right/left symmetrical to a vertical plane passing through a right/left center of the reverse gate 33.

A pair of right and left support brackets 61 are mounted to the nozzle 47. Front end portions of the respective side walls 52 and 53 of the reverse gate 33 are supported by the support brackets 61 via bolts 62, for example. The bolts 62 are inserted through the side walls 52 and 53 of the reverse gate 33 and screwed to the support brackets 61. The bolts 62 are respectively disposed along the up/down rotation axis Ag and at the right and left of the nozzle 47. The reverse gate 33 is thus enabled to rotate around the up/down rotation axis Ag with respect to the nozzle 47.

The front end portions of the respective side walls 52 and 53 include curved end surfaces 33*a* including portions that are arcuate-shaped around the up/down rotation axis Ag. The front end portions of the respective side walls 52 and 53 further include first rectilinear end surfaces 33*b* connected to upper ends of the curved end surfaces 33*a* and extending substantially upward and second rectilinear end surfaces 33*c* connected to lower ends of the curved end surfaces 33*a* and extending substantially downward.

Figure 6:
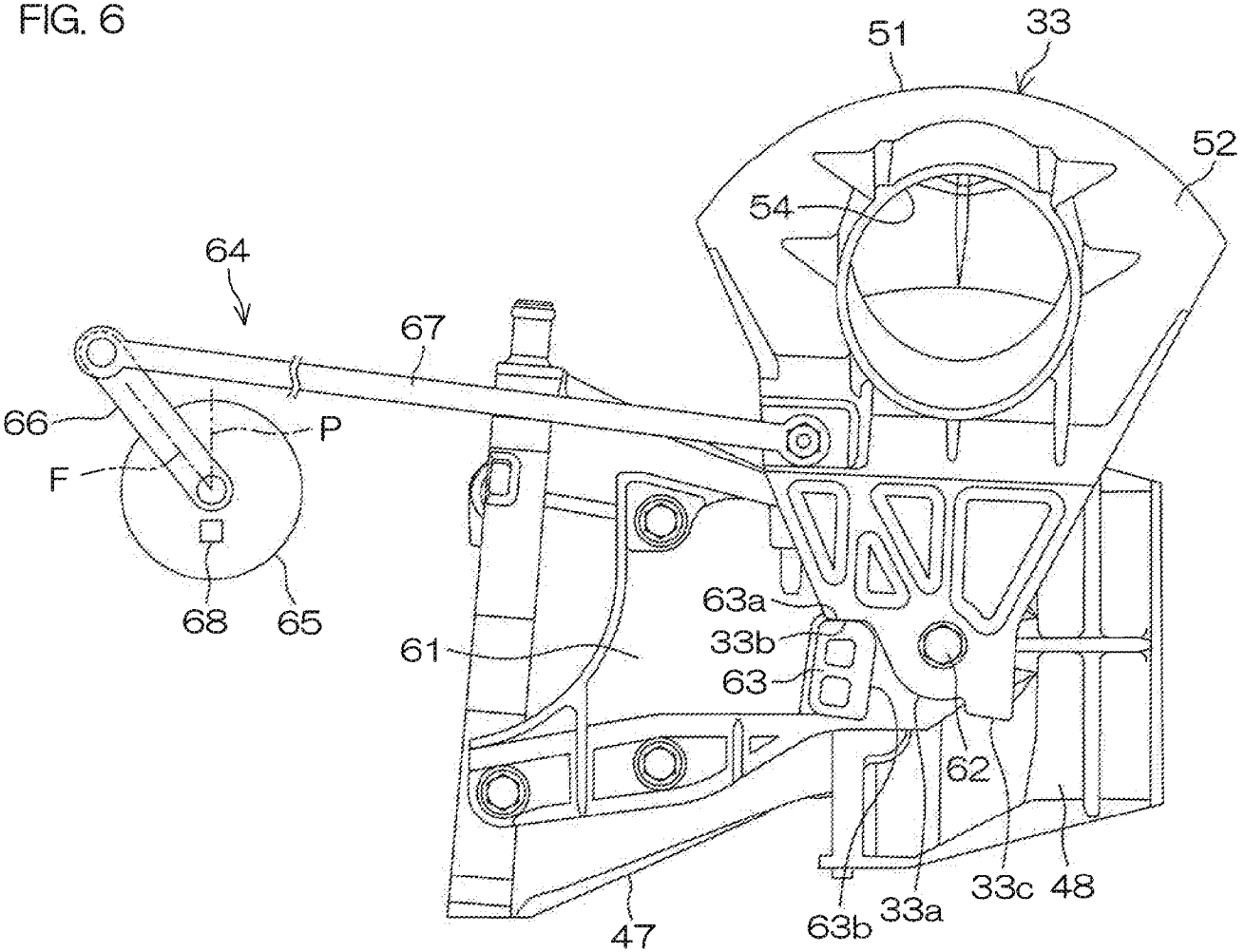
FIG. 6 is a schematic side view of the jet propelled watercraft in a state where the reverse gate is at a forward drive position.
Figure 7:
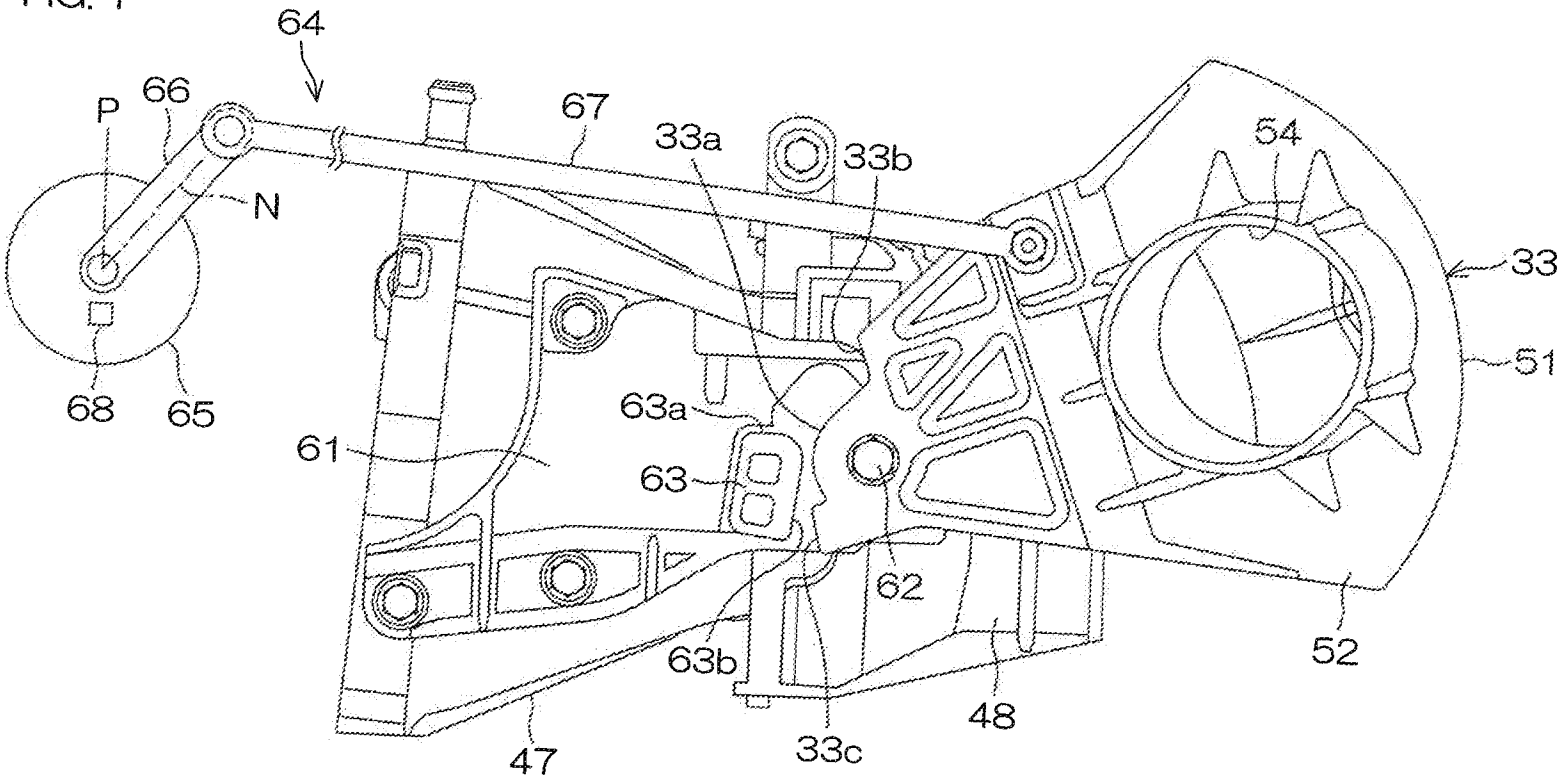
FIG. 7 is a schematic side view of the jet propelled watercraft in a state where the reverse gate is at a neutral position.

The reverse gate 33 is capable of moving to a reverse drive position shown in FIG. 4 and FIG. 5, a forward drive position shown in FIG. 6, and a neutral position shown in FIG. 7 by rotating around the up/down rotation axis Ag. The forward drive position is a position at which the jet port 31 is not covered at all by the rear wall 51 of the reverse gate 33 in a rear view viewed along the jetting direction of the water jetted from the jet port 31 of the deflector 48. The reverse drive position is a position at which the entire jet port 31 of the deflector 48 is covered by the rear wall 51 of the reverse gate 33 in the rear view. The neutral position is a predetermined position between the forward drive position and the reverse drive position and is a position at which a portion of the jet port 31 of the deflector 48 is covered by the rear wall 51 of the reverse gate 33 in the rear view.

In the state where the reverse gate 33 is disposed at the forward drive position (see FIG. 6), the jet port 31 of the deflector 48 is not covered by the reverse gate 33 and therefore the water jetted rearward from the outlet 42 of the nozzle 47 thus passes through the interior of the deflector 48 and is jetted rearward from the jet port 31. A thrust in a forward drive direction that drives the body 2 forward is thus generated.

In the state where the reverse gate 33 is disposed at the reverse drive position (see FIG. 4), the entire jet port 31 of the deflector 48 is covered by the reverse gate 33. The water jetted rearward from the jet port 31 thus collides against an inner surface of the reverse gate 33 and is thereafter jetted obliquely forward to the left and obliquely forward to the right from the left opening 54 and the right opening 55. The reverse gate 33 thus changes the direction of the water, jetted rearward from the jet port 31, toward the front. A thrust in a reverse drive direction that drives the body 2 in reverse is thus generated.

When the reverse gate 33 is disposed at the neutral position (see FIG. 7), a portion of the jet port 31 of the deflector 48 is covered by the reverse gate 33. Therefore, while a portion of the water jetted from the jet port 31 is jetted rearward, another portion of the water jetted from the jet port 31 is jetted obliquely forward to the left and obliquely forward to the right from the left opening 54 and the right opening 55. A thrust in the forward drive direction and a thrust in the reverse drive direction are thus generated. The neutral position is set, for example, at a position at which the forward drive direction thrust and the reverse drive direction thrust are equal or substantially equal.

Each support bracket 61 is provided with a stopper 63 which the reverse gate 33 is pressed against at the forward drive position (see FIG. 6) and the reverse drive position (see FIG. 4). The stopper 63 has a rectangular or substantially rectangular plate shape that is long in the up/down direction in side view. An upper end surface of the stopper 63 is a first stopper surface 63*a* and a rear end surface of the stopper is a second stopper surface 63*b*.

As shown in FIG. 6, when the reverse gate 33 is at the forward drive position, the first rectilinear end surfaces 33*b* of the respective side walls 52 and 53 of the reverse gate 33 are pressed against the first stopper surfaces 63*a* of the stoppers 63. As shown in FIG. 4 and FIG. 5, when the reverse gate 33 is at the reverse drive position, the second rectilinear end surfaces 33*c* of the respective side walls 52 and 53 of the reverse gate 33 are pressed against the second stopper surfaces 63*b* of the stoppers 63. As shown in FIG. 7, when the reverse gate 33 is at the neutral position, the reverse gate 33 is not pressed against the stoppers 63.

The jet propelled watercraft 1 includes a deflector moving mechanism (not shown) that rotates the deflector 48 to the right or left in accordance with an operation amount (steering angle) of the handle 8. The deflector moving mechanism mechanically couples the handle 8 and the deflector 48. The deflector moving mechanism includes, for example, a push-pull cable that transmits an actuation of the handle 8 to the deflector 48. The deflector moving mechanism may be an electrically driven moving mechanism that includes an electric motor, for example. A straight drive position of the handle 8 is associated with a straight drive position of the deflector 48. When the handle 8 is operated, the deflector 48 is rotated to the left or to the right by the deflector moving mechanism. The jetting direction of the water from the jet port 31 is thus changed to the right or left.

The jet propelled watercraft 1 further includes a reverse gate moving mechanism 64 (see FIG. 1, FIG. 4, FIG. 6, and FIG. 7) that rotates the reverse gate 33 up and down based on operation of the first accelerator operator 13 and the second accelerator operator 14. In the present preferred embodiment, the reverse gate moving mechanism 64 includes a shift actuator 65, a shift arm 66 rotated by the shift actuator 65, and a link 67 coupling the shift arm 66 and the reverse gate 33. In the present preferred embodiment, the shift actuator 65 preferably is an electric motor, for example.

The link 67 is pushed or pulled when the shift arm 66 is rotated by the shift actuator 65. The reverse gate 33 is thus rotated around the up/down rotation axis Ag. A shift position of the reverse gate 33 (hereinafter referred to simply as the "shift position") is detected by a shift position sensor 68. The shift position sensor 68 is an example of a shift position detector or a shift state detector that detects the shift position or a shift state. In the present preferred embodiment, the shift position sensor 68 preferably is a potentiometer that detects a rotation angle (rotation amount) of the shift arm 66 from a reference position set in advance.

Figure 8:
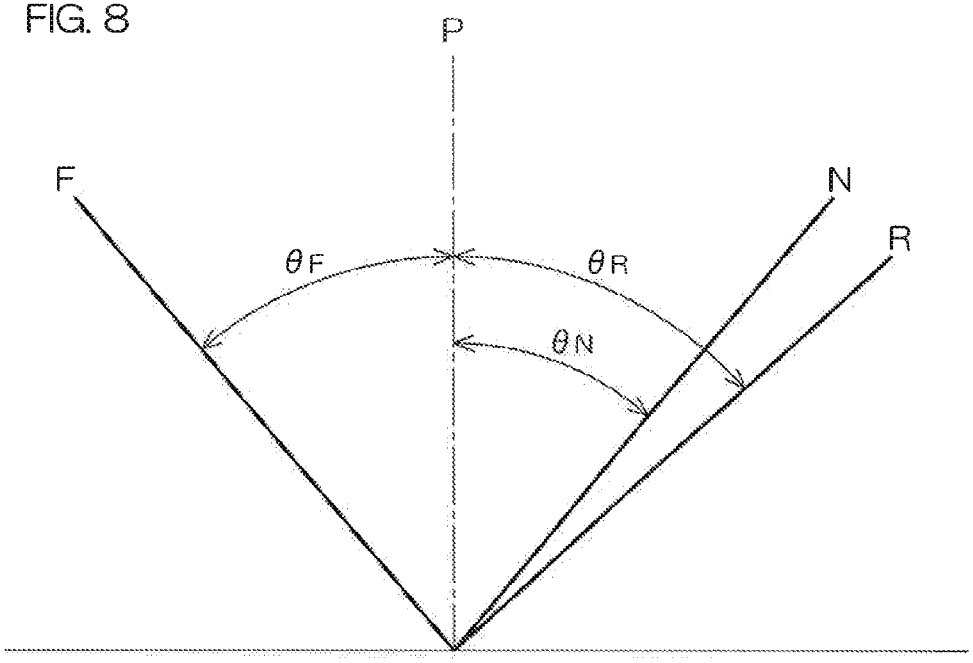
FIG. 8 is a schematic view of rotation angle positions of a shift arm at a forward drive position, a neutral position, and a reverse drive position.

FIG. 8 is a schematic view of rotation angle positions of the shift arm 66 at the forward drive position, the neutral position, and the reverse drive position. In the present preferred embodiment, the reference position P of the shift arm 66 is a position at which the shift arm 66 is perpendicular or substantially perpendicular to a horizontal plane of the body 2. A position F, at which the shift arm 66 is rotated in a counterclockwise direction by just a predetermined angle $\theta_F$ from the reference position P, indicates the rotation angle position of the shift arm 66 corresponding to the forward drive position of the reverse gate 33. A position R, at which the shift arm 66 is rotated in a clockwise direction by just a predetermined angle OR from the reference position P, indicates the rotation angle position of the shift arm 66 corresponding to the reverse drive position of the reverse gate 33. A position N, at which the shift arm 66 is rotated in the clockwise direction by just a predetermined angle $\theta_N$ from the reference position P, indicates the rotation angle position of the shift arm 66 corresponding to the neutral position of the reverse gate 33.

Figure 9:
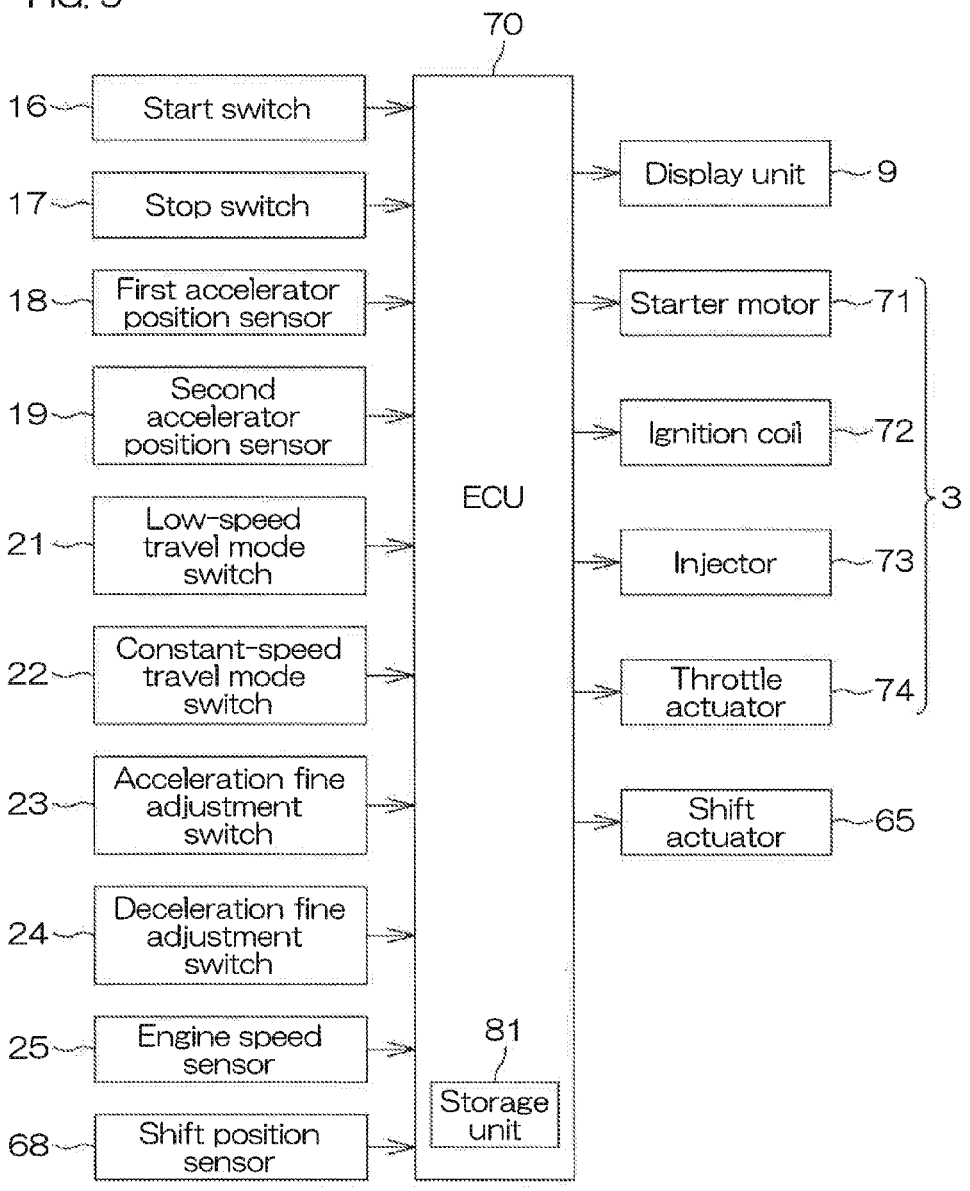
FIG. 9 is a block diagram for describing the electrical arrangement of the jet propelled watercraft.

FIG. 9 is a block diagram for describing the electrical configuration of the jet propelled watercraft 1. The engine 3, the shift actuator 65, the display 9, etc., are controlled by an ECU 70 (electronic controller) the defines a controller. The engine 3 includes a starter motor 71, an ignition coil 72, an injector 73, and a throttle actuator 74.

Switches, including the start switch 16, the stop switch 17, the low-speed travel mode switch 21, the constant-speed travel mode switch 22, the acceleration fine adjustment switch 23, and the deceleration fine adjustment switch 24, are connected to the ECU 70. Further, sensors, including the first accelerator position sensor 18, the second accelerator position sensor 19, the engine speed sensor 25, and the shift position sensor 68, are connected to the ECU 70.

Further, the display 9, and actuators, such as the starter motor 71, the ignition coil 72, the injector 73, the throttle actuator 74, the shift actuator 65, etc., are connected to the ECU 70. The starter motor 71 is configured to perform cranking of the engine 3. The injector 73 is configured to inject fuel into an air intake path of the engine 3. The throttle actuator 74 is configured to drive a throttle valve (not shown) of the engine 3 to adjust an amount of air supplied to the air intake path of the engine 3. The ignition coil 72 is configured to raise a voltage applied to a spark plug (not shown).

The ECU 70 includes a microcomputer (not shown) and a storage device such as a memory 81 storing a program thereof, etc. The ECU 70 further includes drive circuits (not shown) of the starter motor 71, the throttle actuator 74, and the shift actuator 65. Information expressing the angles $\theta_F$, $\theta_R$, and $\theta_N$ shown in FIG. 8 are stored in the storage device 81.

The ECU 70 calculates a first throttle opening degree Θ1 corresponding to the first accelerator operation amount Am1 detected by the first accelerator position sensor 18. The ECU 70 further calculates a second throttle opening degree Θ2 corresponding to the second accelerator operation amount Am2 detected by the second accelerator position sensor 19.

Figure 10A:
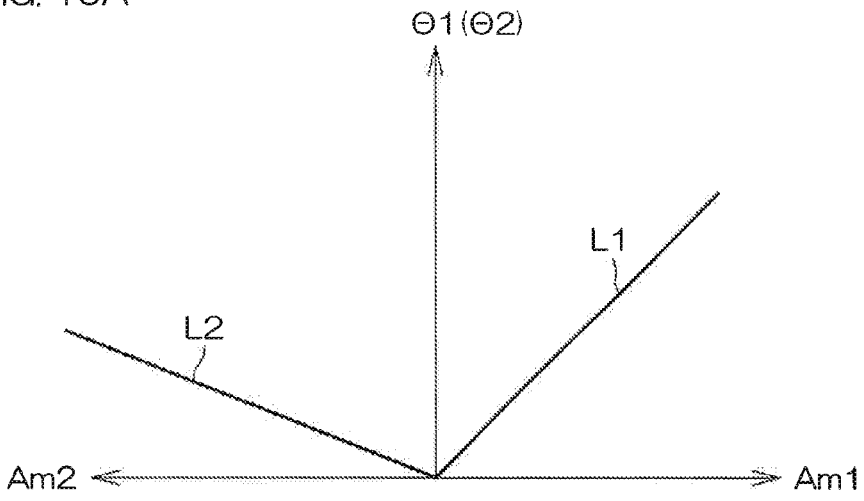
FIG. 10A is a characteristics diagram of a setting example of a throttle opening degree with respect to an accelerator operation amount.

A straight line L1 in FIG. 10A indicates a setting example of the first throttle opening degree Θ1 with respect to the first accelerator operation amount Am1. A straight line L2 in FIG. 10A indicates a setting example of the second throttle opening degree Θ2 with respect to the second accelerator operation amount Am2. The first throttle opening degree Θ1 is set so as to increase linearly as the first accelerator operation amount Am1 increases. Similarly, the second throttle opening degree Θ2 is set so as to increase linearly as the second accelerator operation amount Am2 increases. However, with the present preferred embodiment, a rate of change of the second throttle opening degree Θ2 with respect to the second accelerator operation amount Am2 (slope of the straight line L2) is smaller than a rate of change of the first throttle opening degree Θ1 with respect to the first accelerator operation amount Am1 (slope of the straight line L1). Therefore, when the first accelerator operation amount Am1 and the second accelerator operation amount Am2 are of the same value, the second throttle opening degree Θ2 is less than the first throttle opening degree Θ1.

Figure 10B:
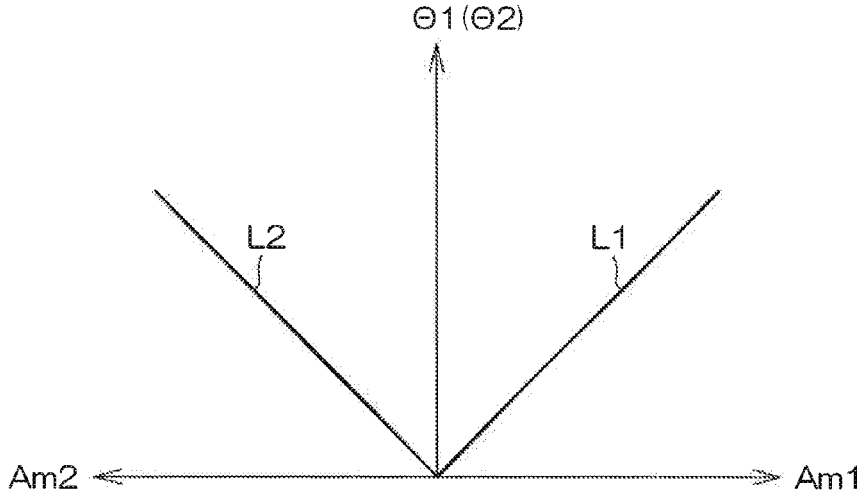
FIG. 10B is a characteristics diagram of another setting example of the throttle opening degree with respect to the accelerator operation amount.

As in another example shown in FIG. 10B, the rate of change of the second throttle opening degree Θ2 with respect to the second accelerator operation amount Am2 (slope of the straight line L2 in FIG. 10B) may be made equal or substantially equal to the rate of change of the first throttle opening degree Θ1 with respect to the first accelerator operation amount Am1 (slope of the straight line L1 in FIG. 10B).

In the ordinary travel mode, the ECU 70 performs an ordinary rotational speed control process and an ordinary shift control process. In the ordinary rotational speed control process, the ECU 70 controls the throttle actuator 74 in accordance with the first throttle opening degree Θ1 and the second throttle opening degree Θ2 to control the engine speed. Specifically, when the shift position is the forward drive position, the ECU 70 controls the throttle opening degree, for example, in accordance with a difference between the first throttle opening degree Θ1 and the second throttle opening degree Θ2 (hereinafter referred to as the "throttle opening degree difference (Θ1−Θ2)"). When the shift position is the reverse drive position or the neutral position, the ECU 70 controls the throttle opening degree, for example in accordance with the throttle opening degree Θ2.

The ECU 70 may perform the ordinary rotational speed control process by the same method as a rotational speed control method disclosed in United States Patent Application Publication No. 2013/0344754. The entire contents of US Patent Application Publication No. 2013/0344754 are incorporated herein by reference.

In the ordinary shift control process, the ECU 70 controls the shift actuator 65 in accordance with the first throttle opening degree Θ1, the second throttle opening degree 82, and the engine speed V detected by the engine speed sensor 25 to control the shift position.

When for example, in a case where the shift position is the forward drive position, the throttle opening degree difference (Θ1-Θ2) is less than a predetermined value, the second accelerator operator 14 is operated, and the engine speed V is greater than a predetermined speed, the ECU 70 switches the shift position to the neutral position. Specifically, the ECU 70 sets a target shift position to the neutral position and thereafter controls the shift actuator 65 to move the reverse gate 33 to the target shift position. The most recent target shift position is held in the storage 81. The ECU 70 judges whether or not the reverse gate 33 has reached the target shift position. Specifically, the ECU 70 judges whether or not the rotation angle detected by the shift position sensor 68 has become equal to the angle, among the angles $\theta_F$, $\theta_R$, and $\theta_N$ stored in the storage 81, corresponding to the target shift position.

When for example, in a case where the shift position is the forward drive position, the throttle opening degree difference (Θ1−Θ2) is less than the predetermined value, the second accelerator operator 14 is operated, and the engine speed V is not more than the predetermined speed, the ECU 70 switches the shift position to the reverse drive position. Specifically, the ECU 70 sets the target shift position to the reverse drive position and thereafter controls the shift actuator 65 to move the reverse gate 33 to the target shift position.

When for example, in a case where the shift position is the neutral position, the engine speed V is less than the predetermined speed and the second accelerator operator 14 is operated, the ECU 70 switches the shift position to the reverse drive position. Specifically, the ECU 70 sets the target shift position to the reverse drive position and thereafter controls the shift actuator 65 to move the reverse gate 33 to the target shift position.

When for example, in a case where the shift position is the neutral position, the engine speed V is less than the predetermined speed, the second accelerator operator 14 is not operated, and the first accelerator operator 13 is operated, the ECU 70 switches the shift position to the forward drive position. Specifically, the ECU 70 sets the target shift position to the forward drive position and thereafter controls the shift actuator 65 to move the reverse gate 33 to the target shift position.

When for example, in a case where the shift position is the reverse drive position, the second accelerator operator 14 is not operated and the first accelerator operator 13 is operated, the ECU 70 switches the shift position to the forward drive position. Specifically, the ECU 70 sets the target shift position to the forward drive position and thereafter controls the shift actuator 65 to move the reverse gate 33 to the target shift position.

When for example, in a case where the shift position is the reverse drive position, a state where the second accelerator operator 14 and the first accelerator operator 13 are not operated is sustained for not less than a predetermined time, the ECU 70 switches the shift position to the neutral position. Specifically, the ECU 70 sets the target shift position to the neutral position and thereafter controls the shift actuator 65 to move the reverse gate 33 to the target shift position.

The reverse gate 33 is thus controlled in position in accordance with the operation of the second accelerator operator 14. That is, the second accelerator operator 14 and the second accelerator position sensor 19 that detects the operation amount thereof constitute a shift switching signal output that outputs a shift switching signal or a shift position command signal output that outputs a shift position command signal.

The ECU 70 may perform the ordinary shift control process by the same method as a shift control method disclosed in United States Patent Application Publication No. 2013/0344754.

Figure 11A:
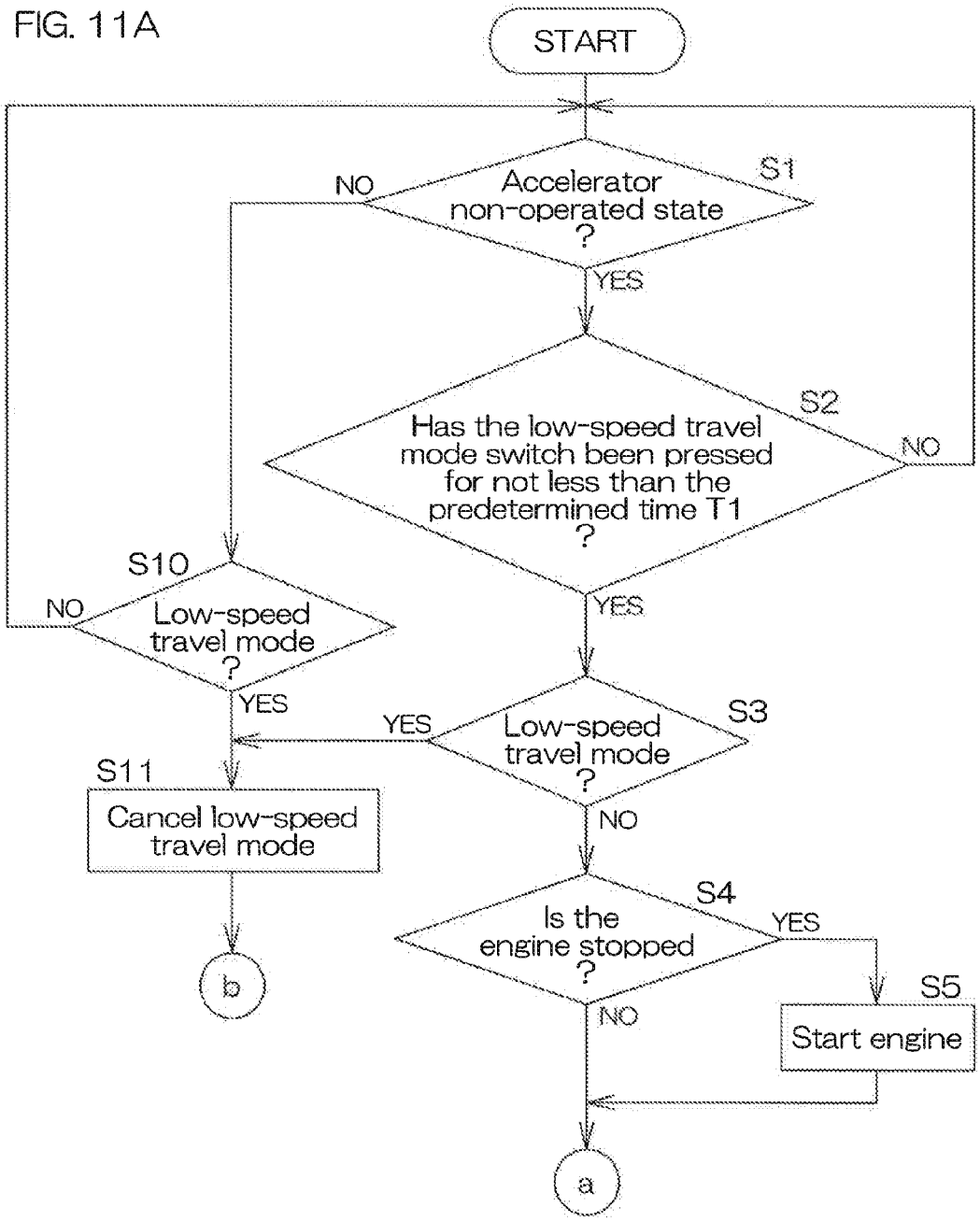
FIG. 11A is a flowchart of a portion of an ECU actuation related to setting and canceling of a low-speed travel mode.
Figure 11B:
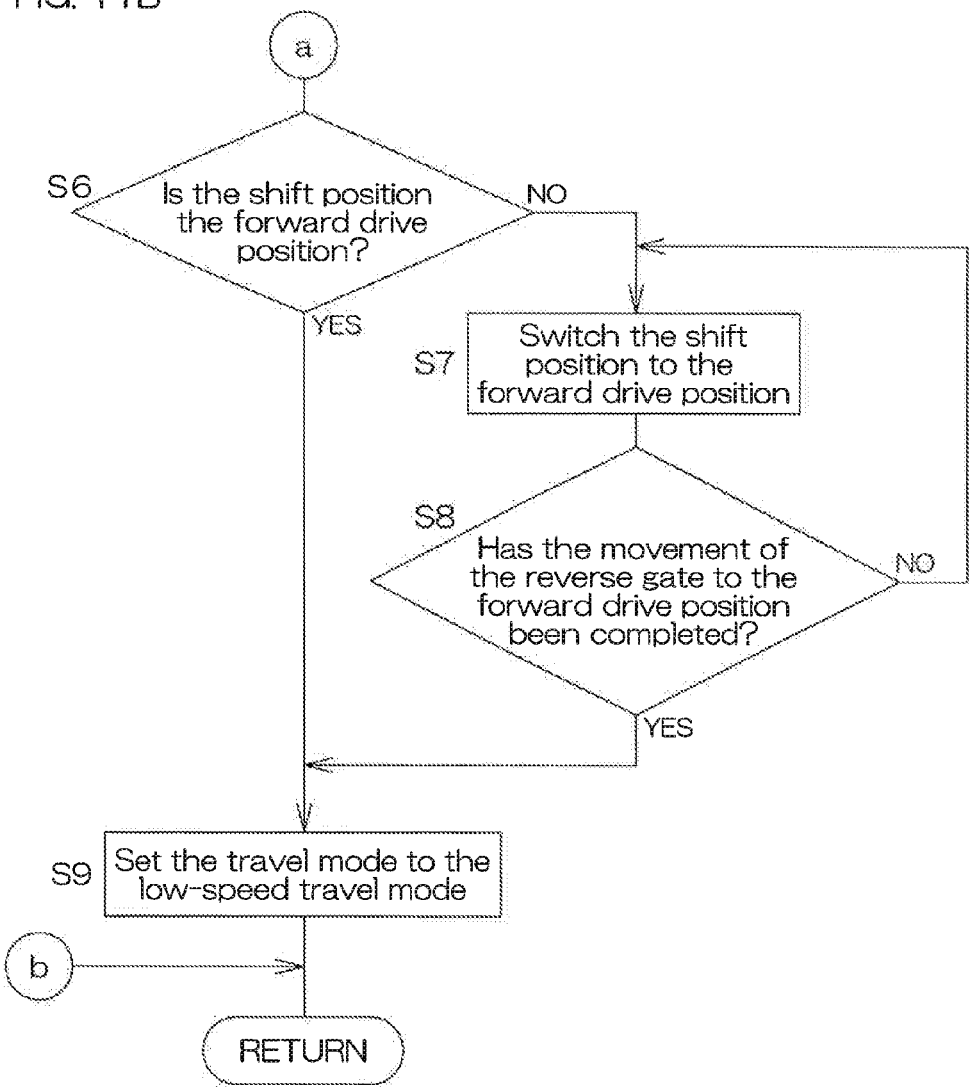
FIG. 11B is a flowchart of a portion of the ECU actuation related to the setting and canceling of the low-speed travel mode.

FIG. 11A and FIG. 11B are flowcharts of actuation of the ECU 70 related to setting and canceling of the low-speed travel mode.

The ECU 70 determines whether or not the current state is a state in which neither the first accelerator operator 13 nor the second accelerator operator 14 is being operated (hereinafter referred to as the "accelerator non-operated state") (step S1). The ECU 70 determines that the current state is the accelerator non-operated state when, for example, the first accelerator operation amount Am1 is not more than a first predetermined amount α1 and the second accelerator operation amount Am2 is not more than a second predetermined amount α2. On the other hand, when the first accelerator operation amount Am1 is greater than the first predetermined amount α1 or the second accelerator operation amount Am2 is greater than the second predetermined amount α2, the ECU 70 determines that the current state is not the accelerator non-operated state.

The ECU 70 may determine that the current state is the accelerator non-operated state when the engine speed detected by the engine speed sensor 25 is less than a predetermined speed and determine that the current state is not the accelerator non-operated state when the engine speed is not less than the predetermined speed.

The ECU 70 may determine that the current state is the accelerator non-operated state when the opening degree of the throttle valve of the engine 3 is less than a predetermined opening degree.

If the current state is determined to be the accelerator non-operated state (step S1: YES), the ECU 70 determines whether or not the low-speed travel mode switch 21 has been pressed for not less than a predetermined time T1 (step S2). If it is determined that the low-speed travel mode switch 21 has been pressed for not less than the predetermined time T1 (step S2: YES), the ECU 70 determines whether or not the currently set travel mode is the low-speed travel mode (step S3).

If the currently set travel mode is not the low-speed travel mode (step S3: NO), the ECU 70 determines whether or not the engine 3 is stopped (step S4). The ECU 70 determines that the engine 3 is stopped when, for example, the engine speed V is less than a predetermined speed 13. On the other hand, the ECU 70 determines that the engine 3 is in operation when the engine speed V is not less than the predetermined speed 13.

If the engine 3 is determined to be in operation (step S4: NO), the ECU 70 enters step S6. On the other hand, if the engine 3 is determined to be stopped in step S4 (step S4: YES), the ECU 70 starts the engine 3 (step S5) and thereafter enters step S6.

In step S6, the ECU 70 determines whether or not the shift position is the forward drive position. This judgment is made based on the rotation angle of the shift arm 66 that is detected by the shift position sensor 68. If the shift position is determined to be the forward drive position (step S6: YES), the ECU 70 enters step S9. On the other hand, if the shift position is determined not to be the forward drive position in step S6 (step S6: NO), the ECU 70 controls the shift actuator 65 to switch the shift position to the forward drive position (step S7). That is, the ECU 70 controls the shift actuator 65 to move the reverse gate 33 to the forward drive position. When the movement of the reverse gate 33 to the forward drive position is completed (step S8: YES), the ECU 70 enters step S9. Whether or not the movement of the shift position to the forward drive position has been completed is determined based on the rotation angle of the shift arm 66 that is detected by the shift position sensor 68.

In step S9, the ECU 70 sets the travel mode to the low-speed travel mode. The ECU 70 then returns to step S1.

When the travel mode is set to the low-speed travel mode, the ECU 70 controls the throttle actuator 74 so that the engine speed becomes a predetermined target speed. The target speed is set to a speed that is slightly higher than an idling rotational speed. If when the travel mode is set to the low-speed travel mode, the acceleration fine adjustment switch 23 is pressed, the ECU 70 changes the currently set target speed to increase by just a predetermined speed. On the other hand, if the deceleration fine adjustment switch 24 is pressed, the ECU 70 changes the currently set target speed to decrease by just the predetermined speed.

When the travel mode is set to the low-speed travel mode, the ECU 70 may control the throttle actuator 74 so that the throttle opening degree becomes a predetermined target opening degree instead of controlling the engine speed. Also, instead of controlling the engine speed, the ECU 70 may control the throttle actuator 74 so that the watercraft speed becomes a predetermined speed.

If in step S1, the present state is determined not to be accelerator non-operated state (step S1: NO), the ECU 70 determines whether or not the currently set travel mode is the low-speed travel mode (step S10). If the currently set travel mode is determined to be the low-speed travel mode (step S10: YES), the ECU 70 cancels the low-speed travel mode and sets the travel mode to the ordinary travel mode (step S11). The ECU 70 then returns to step S1. That is, when, in the low-speed travel mode, at least one of either of the first accelerator operator 13 and the second accelerator operator 14 is operated, the low-speed travel mode is cancelled.

If in step S10, the currently set travel mode is determined not to be the low-speed travel mode (step S10: NO), the ECU 70 returns to step S1.

If in step S3, the currently set travel mode is determined to be the low-speed travel mode (step S3: YES), the ECU 70 cancels the low-speed travel mode and sets the travel mode to the ordinary travel mode (step S11). That is, when in the low-speed travel mode, the low-speed travel mode switch 21 is pressed for not less than the predetermined time T1, the low-speed travel mode is cancelled. The ECU 70 then returns to step S1.

If in step S2, it is determined that the low-speed travel mode switch 21 has not been pressed for not less than the predetermined time T1 (step S2: NO), the ECU 70 returns to step S1.

With the present preferred embodiment described above, when, while the jet propelled watercraft 1 is traveling in the ordinary travel mode or the constant-speed travel mode, the low-speed travel mode switch 21 is pressed for not less than the predetermined time T1 with the current state being the accelerator non-operated state, it is determined whether or not the shift position is the forward drive position (step S6). If the shift position is not the forward drive position, the shift position is automatically switched to the forward drive position and thereafter the travel mode is set to the low-speed travel mode (steps S7 to S9).

Therefore, even when the shift position is other than the forward drive position, the operator is able to set the travel mode to the low-speed travel mode by simply pressing the low-speed travel mode switch 21 for not less than the predetermined time T1 in the accelerator non-operated state. Therefore when the shift position is other than the forward drive position, the travel mode is able to be set to the low-speed travel mode even if the operator does not perform an operation to switch the shift position to the forward drive position. The operation to switch the travel mode to the low-speed travel mode is thus made simple.

Further, when, while the engine 3 is stopped, the low-speed travel mode switch 21 is pressed for not less than the predetermined time T1 with the current state being the accelerator non-operated state, the engine 3 is started automatically (step S5). If the shift position is the forward drive position, the travel mode is set to the low-speed travel mode. On the other hand, if the shift position is other than the forward drive position, the shift position is automatically switched to the forward drive position and thereafter the travel mode is set to the low-speed travel mode.

Therefore, even in the state where the engine 3 is stopped, the operator is able to set the travel mode to the low-speed travel mode by pressing the low-speed travel mode switch 21 for not less than the predetermined time T1 in the accelerator non-operated state. Travel in the low-speed travel mode is thus started by a simple operation even when the engine 3 is in the stopped state.

With the present preferred embodiment, the shift position of the reverse gate 33 preferably is switched in accordance with the second accelerator operation amount Am2. On the other hand, when the low-speed travel mode switch 21 is pressed for not less than the predetermined time T1, the shift position of the reverse gate 33 is automatically switched to the forward drive position regardless of the second accelerator operation amount Am2. The operation to switch the travel mode to the low-speed travel mode is thus simple.

With the present preferred embodiment, the reverse gate 33 preferably is automatically guided to the forward drive position when the low-speed travel mode switch 21 is pressed for not less than the predetermined time T1. The operation to switch the travel mode to the low-speed travel mode is thus simple.

With the present preferred embodiment, the shift position sensor 68 is configured to detect the position of the reverse gate 33. The position of the reverse gate 33 is thus controlled automatically in the process of switching the travel mode.

With the present preferred embodiment, when switching to the low-speed travel mode is performed, the shift position is automatically set to the forward drive position and therefore the operation to switch to the low-speed travel mode is simple.

With the present preferred embodiment, the ECU 70 switches the travel mode from the ordinary travel mode to the low-speed travel mode when the low-speed travel mode switch 21 is pressed for not less than the predetermined time T1 under the condition that the current state is the accelerator non-operated state (or that the rotational speed of the engine 3 is not more than the predetermined speed). The switching from the ordinary travel mode to the low-speed travel mode can thus be performed appropriately, and in this process, the shift position of the reverse gate 33 is automatically guided to the forward drive position. The switching of the travel mode from the ordinary travel mode to the low-speed travel mode is thus performed appropriately by a simple operation.

With the present preferred embodiment, the ECU 70 switches the travel mode to the low-speed travel mode after switching the shift position of the reverse gate 33 to the forward drive position. The shift position is thus automatically controlled appropriately first and then the travel mode is switched so that an appropriate mode switching actuation by a simple operation is realized by automatic control.

With the present preferred embodiment, when the low-speed travel mode switch 21 is pressed for not less than the predetermined time T1 and the shift position sensor 68 is detecting the forward drive position, the ECU 70 switches the travel mode to the low-speed travel mode without switching the shift position of the reverse gate 33. If the shift position is the forward drive position, the control of changing the shift position is unnecessary. The shift position is thus automatically set appropriately and the travel mode is switched by a simple operation while eliminating waste of control.

With the present preferred embodiment, if, when the engine 3 is stopped, the low-speed travel mode switch 21 is pressed for not less than the predetermined time T1 and the shift position is the forward drive position, the engine 3 is started automatically and the travel mode is set to the low-speed travel mode without switching the shift position. The operation for starting in the low-speed travel mode is thus simple.

When it is determined that the engine 3 is stopped in step S4 of FIG. 11A, the ECU 70 may return to step S1 without entering step S5. In this case, the switching to the low-speed travel mode is not performed when the engine 3 is stopped. That is, switching to the low-speed travel mode may be enabled only when the engine 3 is being driven.

Although a preferred embodiment of the present invention has been described above, the present invention may be implemented in yet other preferred embodiments.

For example, with the present preferred embodiment described above, when the shift position is determined not to be the forward drive position in step S6 of FIG. 11B, the travel mode preferably is switched to the low-speed travel mode after switching the shift position to the forward drive position (steps S7 to S9). However, when the shift position is determined not to be the forward drive position in step S6 of FIG. 11B, the shift position may be switched to the forward drive position after switching the travel mode to the low-speed travel mode. Or, when the shift position is determined not to be the forward drive position in step S6 of FIG. 11B, the switching of the shift position to the forward drive position and the switching of the travel mode to the low-speed travel mode may be performed at the same time.

With the present preferred embodiment, in the ordinary travel mode, the ECU 70 preferably performs the ordinary engine speed control process and the ordinary shift control process in accordance with the operation amount of the first accelerator operator 13, the operation amount of the second accelerator operator (reverse gate operator) 14, and the engine speed. However, in the ordinary travel mode, the ECU 70 may control the engine speed in accordance with the operation of the first accelerator operator 13 and perform shift control in accordance with the operation of the second accelerator operator 14. That is, the second accelerator operator 14 may be used just to switch the shift position. In this case, the "accelerator non-operated state" refers to a state where the first accelerator operator 13 is not operated.

Although with the present preferred embodiment, the second accelerator operator 14 preferably is a lever type, it may instead be a grip type or may be a toggle switch or a button switch. Also, although with the present preferred embodiment, the first accelerator operator 13 preferably is a lever type, it may instead be a grip type.

With the present preferred embodiments described above, the shift position of the reverse gate 33 preferably is detected by the shift position sensor 68 that detects the rotation angle of the shift arm 66. However, the shift position may be detected by a plurality of limit switches.

Although with the present preferred embodiments described above, the shift actuator 65 preferably is an electric motor, a hydraulic actuator may be used instead.

Although with the present preferred embodiment, the case where the prime mover is the engine 3 was described, the prime mover may be an electric motor instead.

Although with the present preferred embodiments described above, the engine 3, the shift actuator 65, the display 9, etc., preferably are controlled by a single ECU 70, these may be controlled by a plurality of ECUs instead.

Although with the present preferred embodiment, the case where the jet propelled watercraft is a personal watercraft was described, the present invention may be applied to a jet propelled watercraft of another form, such as a jet boat, a sport boat, etc. Further, the present invention may also be applied in a small vessel having an outboard motor as a propulsion device.

The present application corresponds to Japanese Patent Application No. 2014-162713 filed on Aug. 8, 2014 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A propulsion system configured to apply a propulsive force to a body of a vessel, the vessel propulsion system comprising:

a propulsion device including a shift mechanism capable of being switched among a plurality of shift positions including a forward drive position of applying a forward drive direction propulsive force to the body;

a shift actuator configured to switch the shift position of the shift mechanism;

a shift position detector detecting the shift position of the shift mechanism;

an accelerator operator operated by an operator to set a travel speed of the vessel;

a mode switching signal output outputting a mode switching signal to switch a travel mode among a plurality of travel modes including a first mode of making the vessel travel in accordance with operation of the accelerator operator and a second mode of making the vessel travel in accordance with a command different from the operation of the accelerator operator; and a controller configured or programmed to switch the shift position of the shift mechanism to the forward drive position by controlling the shift actuator and switch the travel mode to the second mode when the mode switching signal output outputs the mode switching signal to switch from the first mode to the second mode and the shift position detector detects a shift position other than the forward drive position.

2. The vessel propulsion system according to claim 1, further comprising:

a shift switching signal output outputting a shift switching signal to switch the shift position of the shift mechanism; wherein the controller is configured or programmed to control the shift actuator in accordance with the shift switching signal output by the shift switching signal output.

3. The vessel propulsion system according to claim 1, wherein the propulsion device includes a jet pump jetting water from a jet port; and the shift mechanism includes a reverse gate movable between a forward drive position at which an entirety of the jet port is open in a rear view viewed along a jetting direction of the water jetted from the jet port and a position besides the forward drive position at which at least a portion of the jet port is covered by the reverse gate in the rear view.

4. The vessel propulsion system according to claim 3, wherein the shift position detector is configured to detect the position of the reverse gate.

5. The vessel propulsion system according to claim 1, wherein the second mode is a low-speed travel mode of making the vessel travel at a predetermined low speed.

6. The vessel propulsion system according to claim 1, wherein the controller is configured or programmed to switch the travel mode from the first mode to the second mode under a condition that a predetermined second mode travel condition is satisfied when the mode switching signal output outputs the mode switching signal to switch from the first mode to the second mode.

7. The vessel propulsion system according to claim 1, wherein the controller is configured or programmed to switch the travel mode to the second mode after switching the shift position of the shift mechanism to the forward drive position.

8. The vessel propulsion system according to claim 1, wherein the controller is configured or programmed to switch the travel mode to the second mode without switching the shift position of the shift mechanism when the mode switching signal output outputs the mode switching signal to switch from the first mode to the second mode and the shift position detector is detecting the forward drive position.

9. The vessel propulsion system according to claim 1, wherein the controller is configured or programmed to start the propulsion device, control the shift actuator to switch the shift position of the shift mechanism to the forward drive position, and set the travel mode to the second mode when, while the propulsion device is stopped, the mode switching signal output outputs the mode switching signal to switch from the first mode to the second mode and the shift position detector detects a shift position other than the forward drive position.

10. The vessel propulsion system according to claim 1, the controller is configured or programmed to start the propulsion device and set the travel mode to the second mode without switching the shift position of the shift mechanism when, while the propulsion device is stopped, the mode switching signal output outputs the mode switching signal to switch the travel mode from the first mode to the second mode and the shift position detector detects the forward drive position.

* * * * *